US008561220B2

(12) United States Patent
Cummings

(10) Patent No.: US 8,561,220 B2
(45) Date of Patent: Oct. 22, 2013

(54) KEEPING SEWER DRAINLINES CLEAR WITH LOW FLUSH TOILETS OR CISTERNS

(75) Inventor: Stephen John Cummings, Newport (AU)

(73) Assignee: Caroma Industries Limited, Brisbane, Queensland (AU)

( * ) Notice: Subject to any disclaimer, the term of this patent is extended or adjusted under 35 U.S.C. 154(b) by 477 days.

(21) Appl. No.: 12/160,480

(22) PCT Filed: Dec. 21, 2006

(86) PCT No.: PCT/AU2006/001988
§ 371 (c)(1),
(2), (4) Date: May 12, 2010

(87) PCT Pub. No.: WO2007/079522
PCT Pub. Date: Jul. 19, 2007

(65) Prior Publication Data

US 2010/0326903 A1 Dec. 30, 2010

(30) Foreign Application Priority Data

Jan. 12, 2006 (AU) ..... 2006900147

(51) Int. Cl.

| | |
|---|---|
| ***E03D 1/10*** | (2006.01) |
| ***E03D 1/24*** | (2006.01) |
| ***E03D 9/00*** | (2006.01) |
| ***B01D 21/26*** | (2006.01) |

(52) U.S. Cl.
USPC ..... 4/321; 4/368; 4/661; 4/DIG. 19; 210/257.1; 210/261; 210/262; 210/512.1; 210/787; 210/790

(58) Field of Classification Search
USPC ..... 210/787, 788, 790, 800, 803, 808, 210/512.1, 512.2, 513, 532.1, 538, 540, 210/519, 532.2, 533, 299, 304, 312, 542, 210/360.1, 360.2, 361, 257.1, 261, 262; 4/318, 321, 336, 337, 344, 368, 661, 4/DIG. 14, DIG. 19
See application file for complete search history.

(56) References Cited

U.S. PATENT DOCUMENTS

| | | | | |
|---|---|---|---|---|
| 1,303,358 | A * | 5/1919 | Montgomery | 4/317 |
| 4,142,261 | A * | 3/1979 | Johansen | 4/300 |

(Continued)

FOREIGN PATENT DOCUMENTS

| | | |
|---|---|---|
| FR | 441.052 | 3/1912 |
| JP | 2002-201693 | 7/2002 |
| JP | 2005-127069 | 5/2005 |
| JP | 2005-143718 | 6/2005 |

(Continued)

*Primary Examiner* — David C Mellon
(74) *Attorney, Agent, or Firm* — Merchant & Gould P.C.

(57) ABSTRACT

A device (20) for improving drainline clearance for use with an ultra low flushing volume toilet (24). The device (20) includes a centrifuge separator means (30), for separating liquids (L) and solids (S), and a reservoir (42). The separator means (30) has a substantially horizontal inlet (32), adapted for connection to the outlet (26) of a toilet pan (24), an outlet (36) primarily for solids (S) and an outlet (38) primarily for liquids (L). The reservoir (42) is beneath the separator means (30) and has an inlet (38) in fluid communication with the liquids outlet (38) of the separator means (30). The reservoir (42) is adapted to syphonically empty substantially all of its contents into a sewerage drainline (22) after at least 2 flushes of the toilet (24). Further, the separator means (30) and the reservoir (42) have a combined vertical dimension less than the maximum height of the toilet pan outlet for installation adjacent the toilet (24) and substantially above the floor level (F) of the toilet (24).

20 Claims, 15 Drawing Sheets

(56) References Cited

U.S. PATENT DOCUMENTS

| | | | | | |
|---|---|---|---|---|---|
| 4,480,655 | A | * | 11/1984 | Teglund et al. | 137/132 |
| 4,547,917 | A | * | 10/1985 | Akesson | 4/300 |
| 2005/0000007 | A1 | * | 1/2005 | Cummings | 4/421 |

FOREIGN PATENT DOCUMENTS

| | | | | |
|---|---|---|---|---|
| WO | WO 96/37440 | | | 11/1996 |
| WO | WO 0008267 | A1 | * | 2/2000 |
| WO | WO 2007001168 | A1 | * | 1/2007 |

* cited by examiner

KEEPING SEWER DRAINLINES CLEAR WITH LOW FLUSH TOILETS OR CISTERNS

FIELD OF THE INVENTION

The present invention relates to a device for improving drainline clearance.

The invention has been primarily developed for use in relation to toilets with cisterns that have an ultra low flushing volume, and will be described hereinafter with reference to this application. The expression "ultra low flushing volume" is herein defined as having nominal full and reduced flush volumes of about 2.5 liters and 2 liters respectively.

A cistern is known as a flush tank in the United States of America.

BACKGROUND OF THE INVENTION

The design of water closets (WCs) in Australia has been greatly influenced by the need to minimise water consumption and maintain adequate sanitation systems to safeguard and maintain a high level of public health. Since 1982, reductions in Australian WC flushing volumes have led to a major lowering of the average daily WC water consumption per person from 55 liters to 16.5 liters.

A major contribution to this reduction was the development of the two button dual flush WC having 6/3 liter reduced flush technology which gave the user the choice of applying either a 6 liter full flush or a 3 liter reduced flush option to operate the WC. More recently, toilets which give the user the choice of applying either a 4.5 liter full flush or a 3 liter reduced flush option have been developed.

Known attempts known to operate toilets with flushing volumes approaching the ultra low flushing volumes referred to above have led to difficulty in transporting solids waste through sewer drainlines.

Further, known devices developed to address these drainline problems have been large, complicated and expensive, and often required installation under the floor on which the toilet is installed. Such installations are not possible due to budgetary and/or space limitations in many buildings.

Object of the Invention

It is the object of the present invention to provide a device for improving drainline clearance for use with an ultra low flushing volume toilet, and that can be installed adjacent the toilet.

SUMMARY OF THE INVENTION

Accordingly, in a first aspect, the present invention provides a device for improving drainline clearance for use with an ultra low flushing volume toilet, the device including:

- a centrifuge separator means for separating liquids and solids, the separator means having a substantially horizontal inlet, adapted for connection to the outlet of a toilet pan, an outlet primarily for solids and an outlet primarily for liquids; and
- a reservoir, beneath the separator means, having an inlet in fluid communication with the liquids outlet of the separator means, the reservoir being adapted to syphonically empty substantially all of its contents into a sewerage drainline, after at least 2 flushes of the toilet,
- wherein the separator means and the reservoir have a combined vertical dimension less than the maximum height of the toilet pan outlet for installation adjacent the cistern and substantially above the floor level of the toilet.

The reservoir is preferably adapted to syphonically empty substantially all of its contents into the sewerage drainline after approximately 2 to 4, most preferably 3, flushes of the toilet.

The liquids outlet of the separator means preferably also functions as the inlet of the reservoir.

The substantially horizontal separator means inlet preferably has a slight downward fall away from the toilet pan outlet, most preferably about a 5 mm fall over its length.

The centrifuge device preferably has a substantially central lower opening through which the solids are directed, with the liquids being directed along the inner surface of the opening to the reservoir.

The separator means preferably has horizontal dimensions larger than its maximum vertical dimension. The reservoir preferably has horizontal dimensions larger than its maximum vertical dimension.

The liquids outlet of the separator means preferably includes a series of inwardly facing fins, most preferably spiralled fins.

The device preferably also includes a duct primarily for solids. The duct preferably has an inlet, most preferably with an outwardly flared upper end, beneath the solids outlet of the separator means. In one form, the duct has a substantially vertical outlet, most preferably a flanged outlet, adapted for connection to a floor mounted sewerage drainline connection. In another form, the duct preferably has a substantially horizontal outlet adapted for connection to a wall mounted sewerage drainline connection.

The reservoir preferably has an outlet connected to the inlet via a syphon pipe. The syphon pipe preferably has an outlet, beneath the reservoir, adapted to direct the contents of the reservoir into the sewerage drainline, most preferably via the duct. The syphon pipe outlet is preferably below the floor level of the toilet.

As used herein, the term "solids" includes human faecal waste and toilet paper.

DESCRIPTION OF THE DRAWINGS

Preferred embodiments of the invention will now be described, by way of examples only, with reference to the accompanying drawings, in which.

DETAILED DESCRIPTION OF THE PREFERRED EMBODIMENTS

Figure 1:
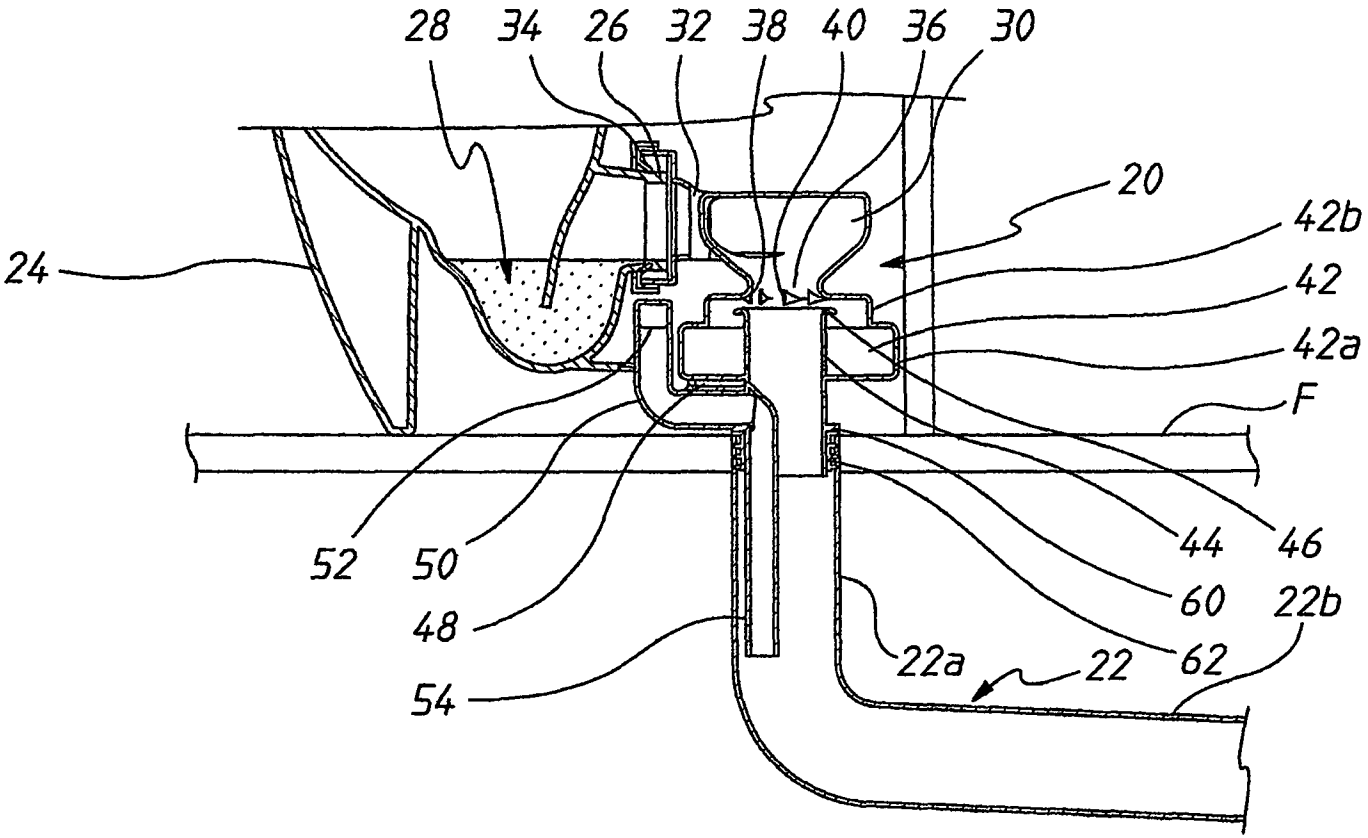
FIG. 1 is a cross sectional side view of a first embodiment of a device for improving drainline clearance, installed adjacent a toilet, prior to flushing of the toilet.

FIG. 1 shows a first embodiment of a device 20 for improving clearance of a drainline 22. The drainline 22 comprises an initial vertical part or riser 22*a* followed by a slightly downwardly angled part 22*b*. The device 20 is shown installed adjacent a toilet, of which only a toilet pan 24 is shown, installed on floor F. The toilet's cistern is omitted to improve drawing clarity. The toilet pan 24 includes an outlet 26 and a water seal or water trap 28.

The device 20 includes a centrifuge separator means 30 for separating liquid and solid waste. The separator means 30 has a substantially horizontal (tangential) inlet 32 which is connected, at seal 34, to the outlet 26 of the toilet pan 24. The inlet 32 has a slight downward fall away from the outlet 26 of about 5 mm over its length. The separator means 30 also has an outlet 36 primarily for solids and an outlet 38 primarily for liquids. The solids outlet 36 is in the form of the central lower opening in the lowermost surface of the separator means 30. The liquids outlet 38 is in the form of the inwardly facing curved surface surrounding the solids outlet/opening 36. It should be appreciated that the separator means 30 may not always completely separate solid and liquid wastes. A small percentage of the liquid waste may also travel with the solid waste (e.g. with toilet paper) through the solids outlet, hence the prior characterisation of the solids outlet as an outlet "primarily" for solids and the liquids outlet as an outlet "primarily" for liquids. The operation of the two outlets 36, 38 shall be described in more detail below. Further, the liquids outlet (surface) 38 includes a number of inwardly directed, spiraled fins 40 whose function shall also be described in more detail below.

The device 20 also includes a reservoir 42 in fluid communication with the liquids outlet 38 and a duct 44 beneath the solids outlet 36. The liquids outlet surface 38 also functions as an inlet to the reservoir 42. The duct 44 has an outwardly flared upper end 46, whose function shall be described in more detail below.

The reservoir 42 has a wider lower part 42*a* and a narrower upper part 42*b*. The reservoir 42 also has an outlet 48 in fluid communication with a syphon pipe 50 having a weir height 52. The weir height 52 is at the same height as the boundary between the wider and narrower parts 42*a* and 42*b* of the reservoir 42, the purpose of which will be described in more detail below. The syphon pipe 50 has a lower outlet pipe 54 which extends into the vertical part 22*a* of the drainline 22. The upper end of the outlet pipe 54 passes through the lower end of the duct 44 to join the lower end of the syphon pipe 50.

The duct 44 includes a locating flange 60 and a seal 62 at its lower end to seal it with respect to the upper end of the drainline vertical part 22*a* at or near the level of the floor F.

The separator means 30 is generally cylindrical in shape and is about 120 mm high and 200 mm in diameter. The reservoir 42 is generally rectangular in shape, albeit stepped, and is about 100 mm high and about 300 mm by 280 mm and 190 mm by 210 mm at parts 42*a* and 42*b* respectively. The separator means 30 and the reservoir 42 are thus both about two to three times wider than they are high. This width to height ratio, the horizontal inlet 32 of the separator means 30, and the positioning of the reservoir 42 directly under the separator means 30, results in the device 20 being compact. This compactness advantageously allows the device 20 to be installed on the floor level F on which the toilet pan 24 is installed. Further, the combined vertical dimension (i.e. installed height) of the separator means 30 and the reservoir 42 of the device 20 does not extend above the maximum height of the upper most part of the pan outlet 26. In new installations, this allows the device 20 to be simply and easily installed behind the toilet pan 24 and thus concealed from view. The device 20 is also suitable for retrofitted installations as it can be easily connected to an existing S trap style drainline without costly modifications to the floor or foundations or the like.

The operation of the device 20 will now be described. FIG. 1 shows the device 20 prior to operation of the toilet (or following operation of the device 20).

Figure 2:
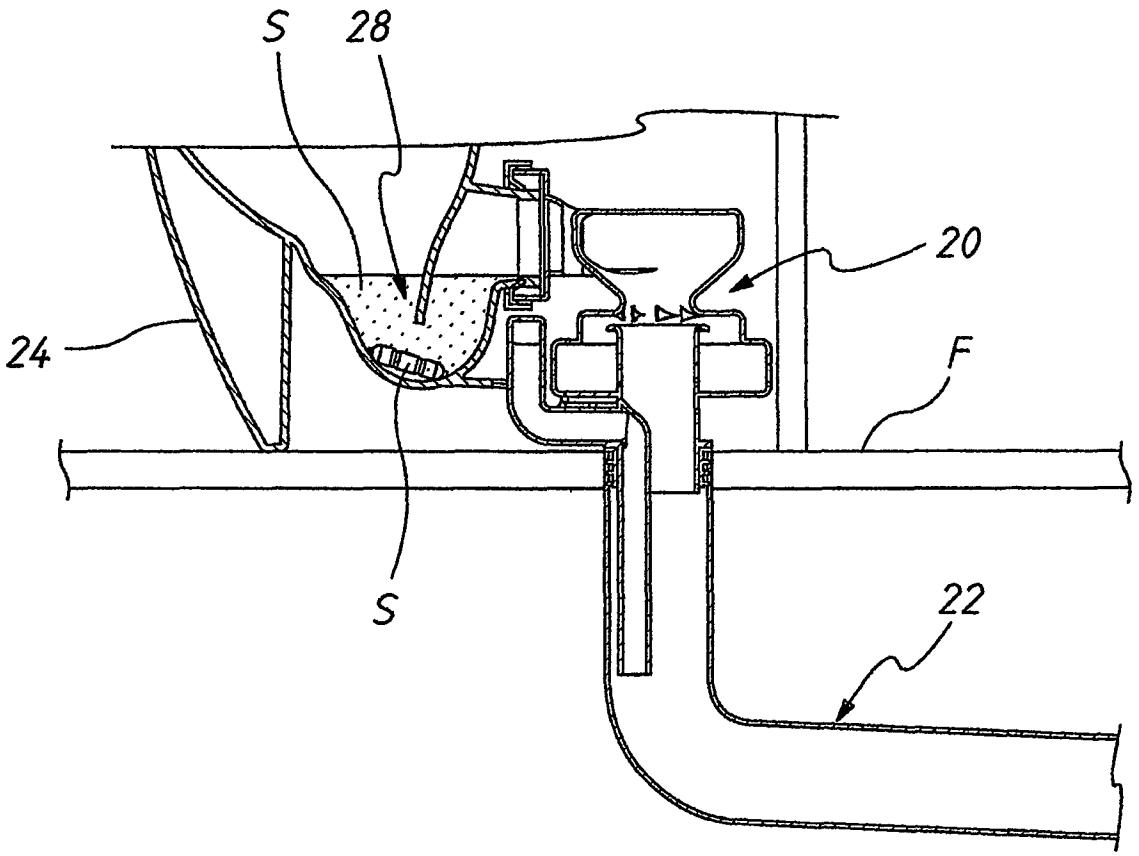
FIGS. 2 to 9 are cross sectional side views of the device and toilet shown in FIG. 1 showing sequential steps in the operation of the device and toilet.

FIG. 2 shows the device 20 and toilet pan 24 after the pan has received solid waste S and/or liquid waste L.

Figure 3:
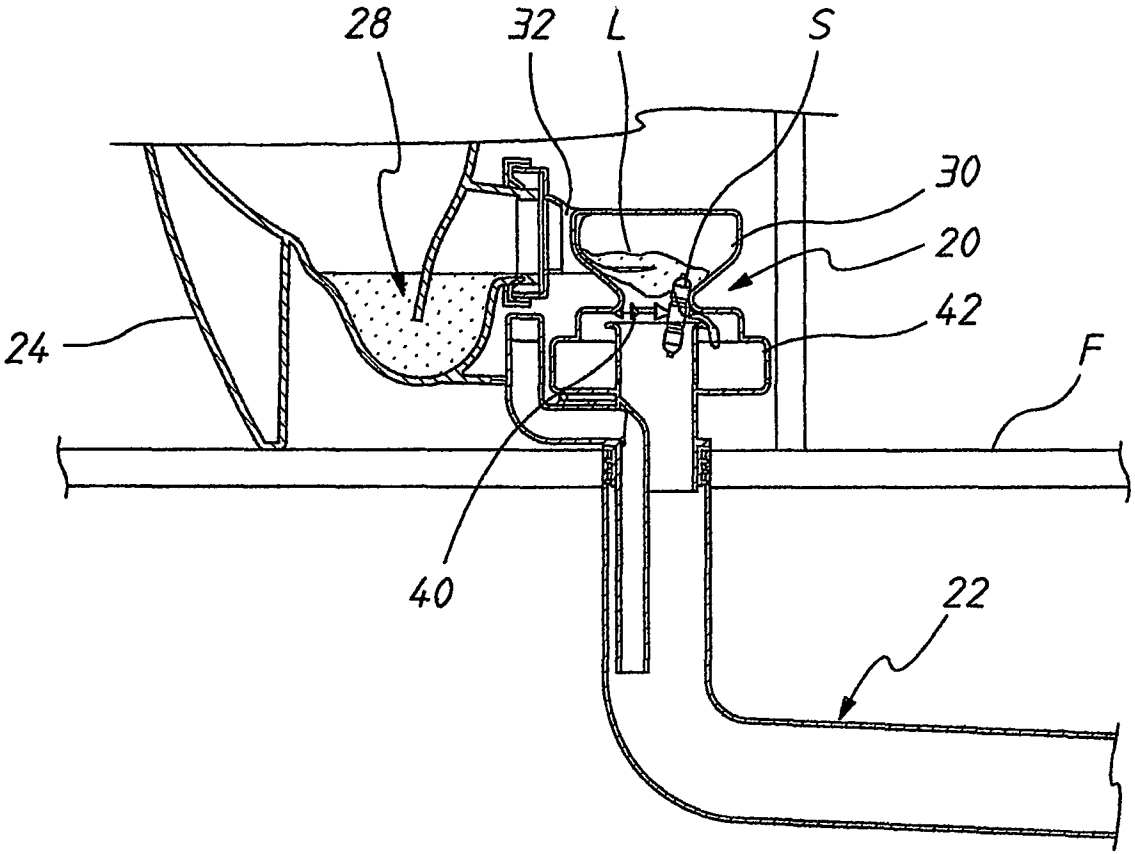
Figure 4:
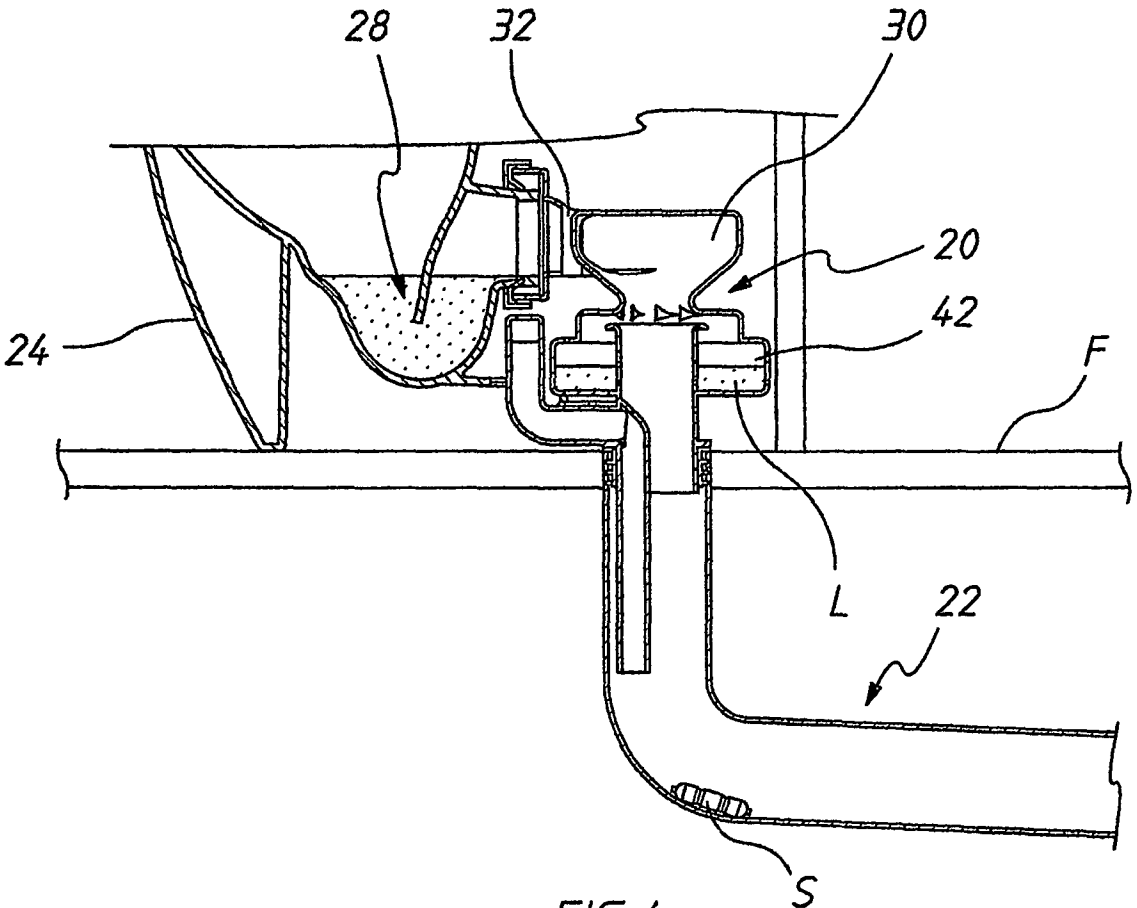

FIG. 3 shows the device 20 and toilet pan 24 after flushing of the cistern which causes the liquid in the pan seal 28 and the wastes S and L to flow through the inlet 32 of the separator means 30. During this process the heavier solids waste S fall through the solids outlet 36 and travel through the duct 42 and into the drainline 22, as shown in FIG. 4. However, the centrifugal or swirling action of the accompanying water and liquid waste causes the majority of the water and liquid waste L to adhere to the outside of the separator means liquid outlet surface 38 and follow the surface 38 into the reservoir 42. The spiraled fins 40 prevent paper waste from adhering to the surface 38, whilst not interrupting the swirling liquid flow caused by the centrifuge action of the separator means 30. The outwardly flared upper end 46 of the duct 44 prevents solids waste, especially toilet paper, from getting caught on the end 46 of the duct 44.

FIG. 4 shows the device 20 and toilet pan 24 after the flushing cycle is complete with the reservoir 42 now partially fulfilled by the flushing liquid and the solids waste S in the drainline 22.

Figure 5:
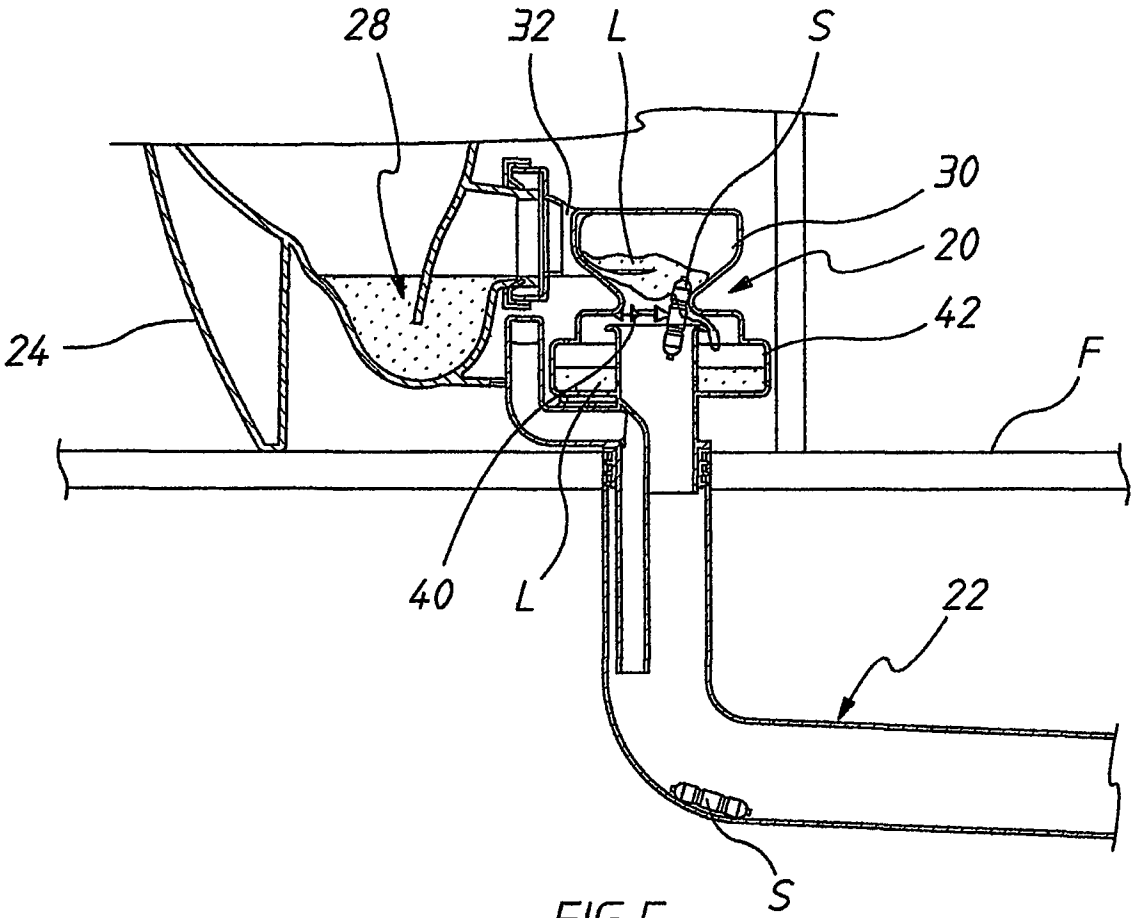

FIG. 5 shows the device 20 and toilet pan 24 during a second flushing and separation cycle.

Figure 6:
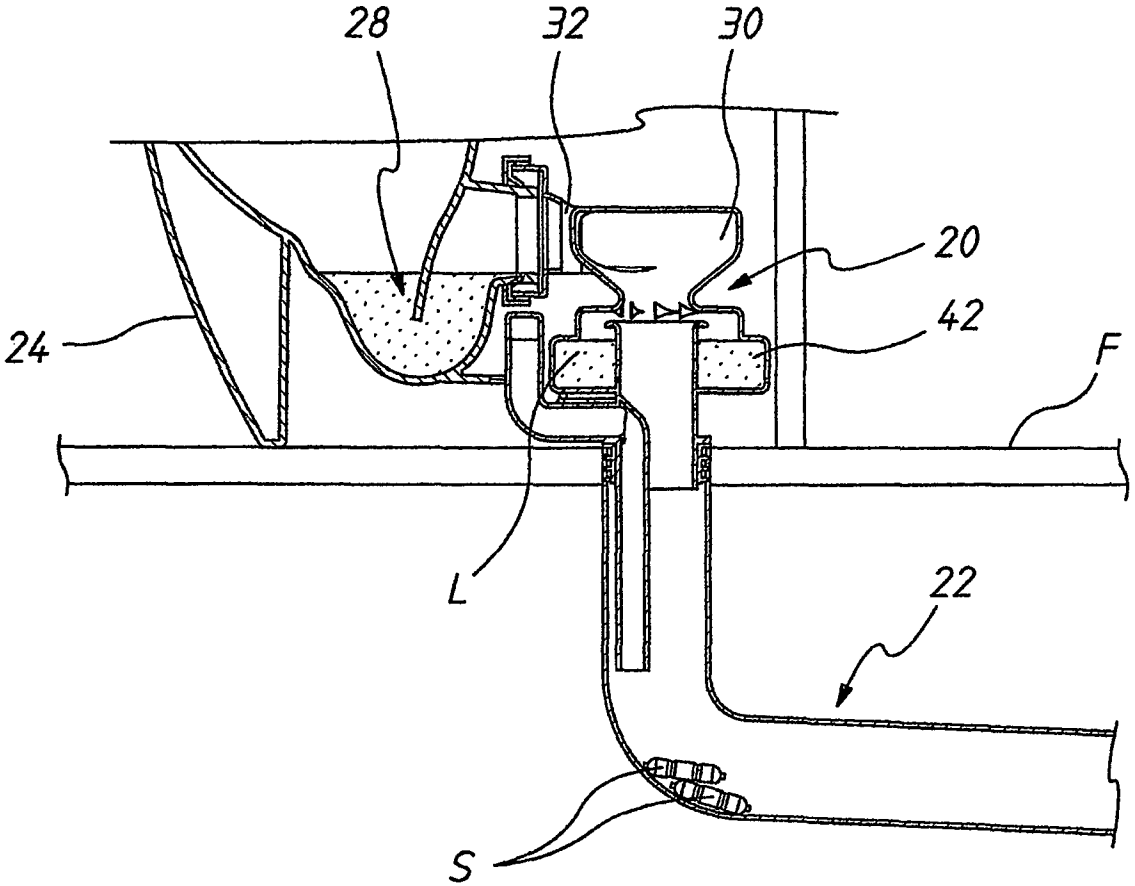

FIG. 6 shows the device 20 and toilet pan 24 at the end of the second flushing cycle with the volume in the reservoir 42, and the solids waste S in the drainline 22, increased by the flushing liquid.

Figure 7:
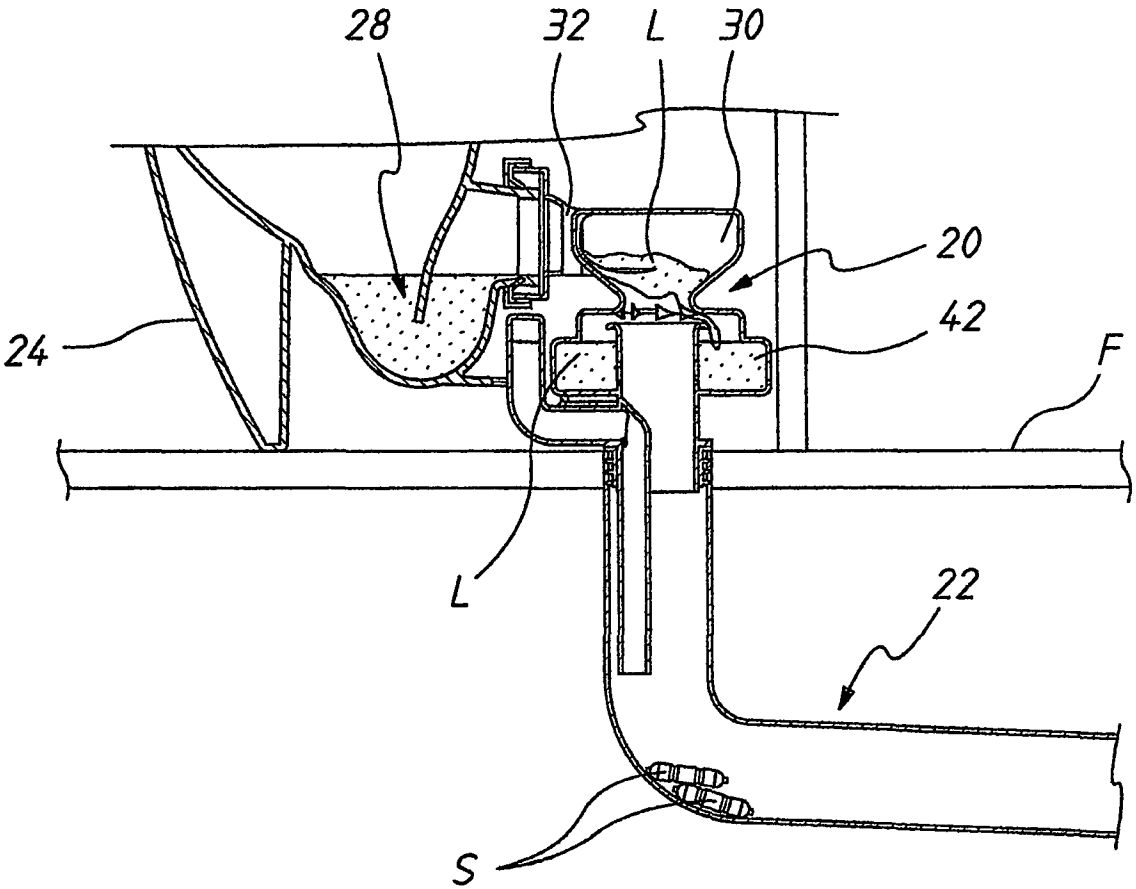

FIG. 7 shows the device 20 and toilet pan 24 during a third flushing cycle.

Figure 8:
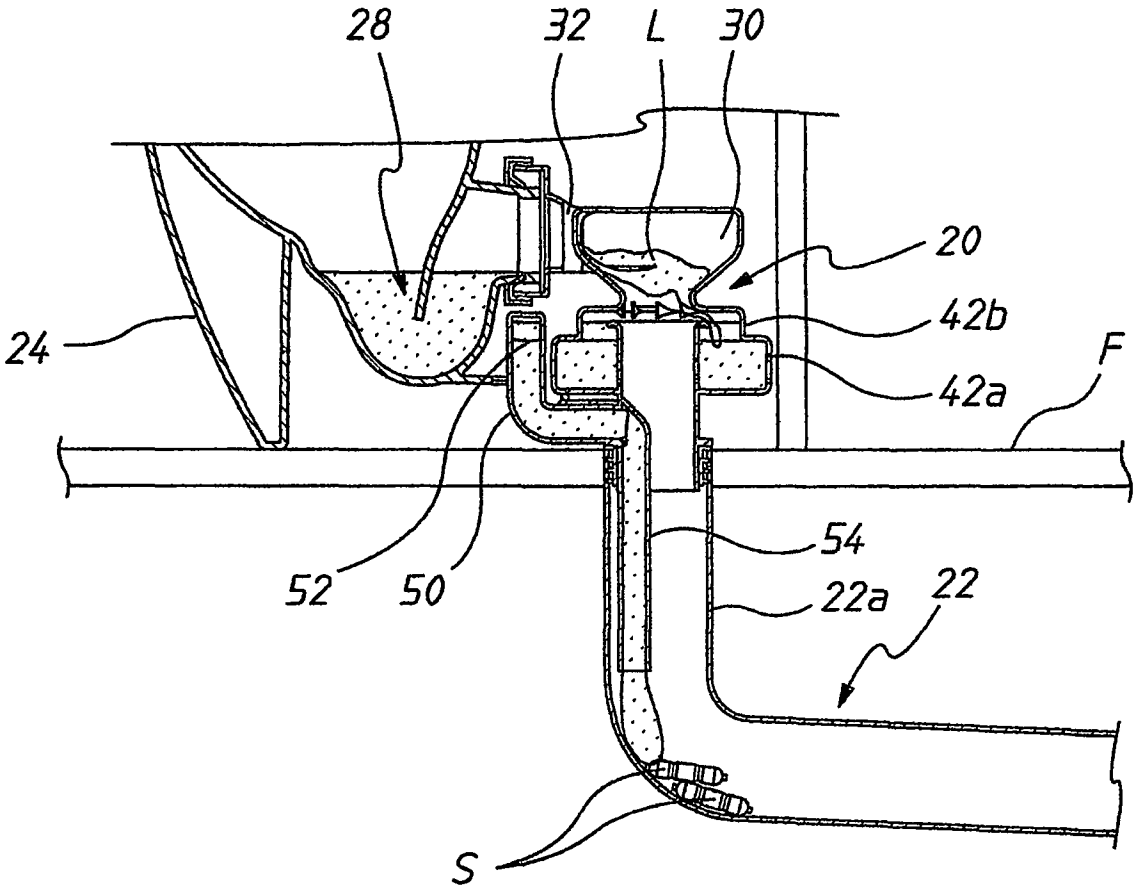

FIG. 8 shows the device 20 and the toilet pan 24 towards the end of the third flushing cycle which results in the reservoir 42 being filled above the weir height 52 of the syphon pipe 50. The syphon pipe 50 then overflows and initiates syphonic emptying of the contents of the reservoir 42 through the pipe 54 and into the drainline 22. The upper narrowed part 42*a* of the reservoir 42 causes an acceleration in the height increase of the rising liquid to ensure a strong positive overflow of liquid initiates the syphoning action. The extension of the syphon outlet pipe 54 below the floor level F and into the vertical part 22*a* of the drainline 22 further improves the syphonic action as it increases the head height between the weir height 52 and the lower end of the outlet pipe 54. The increased head height ensures a fast and powerful emptying of the contents of the reservoir 42. A venturi can also be added to the pipe 54 to further improve the syphonic action.

Figure 9:
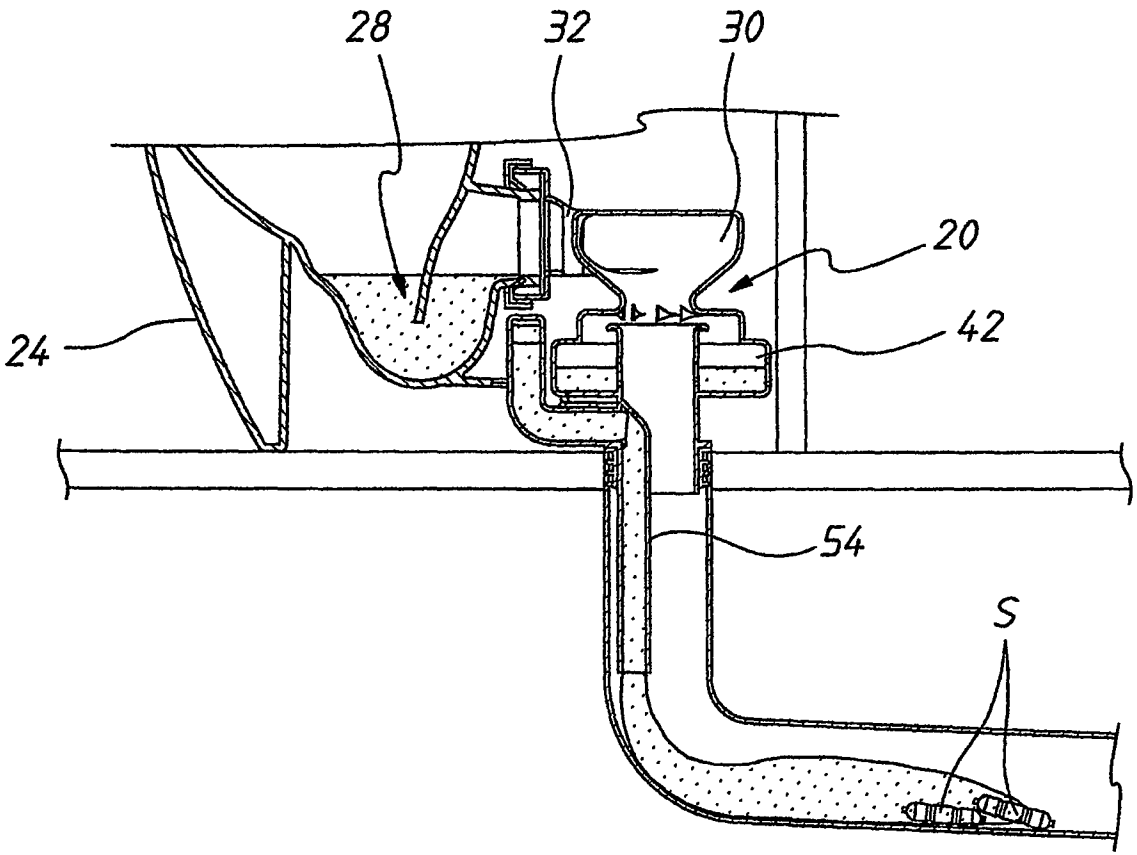
Figure 10:
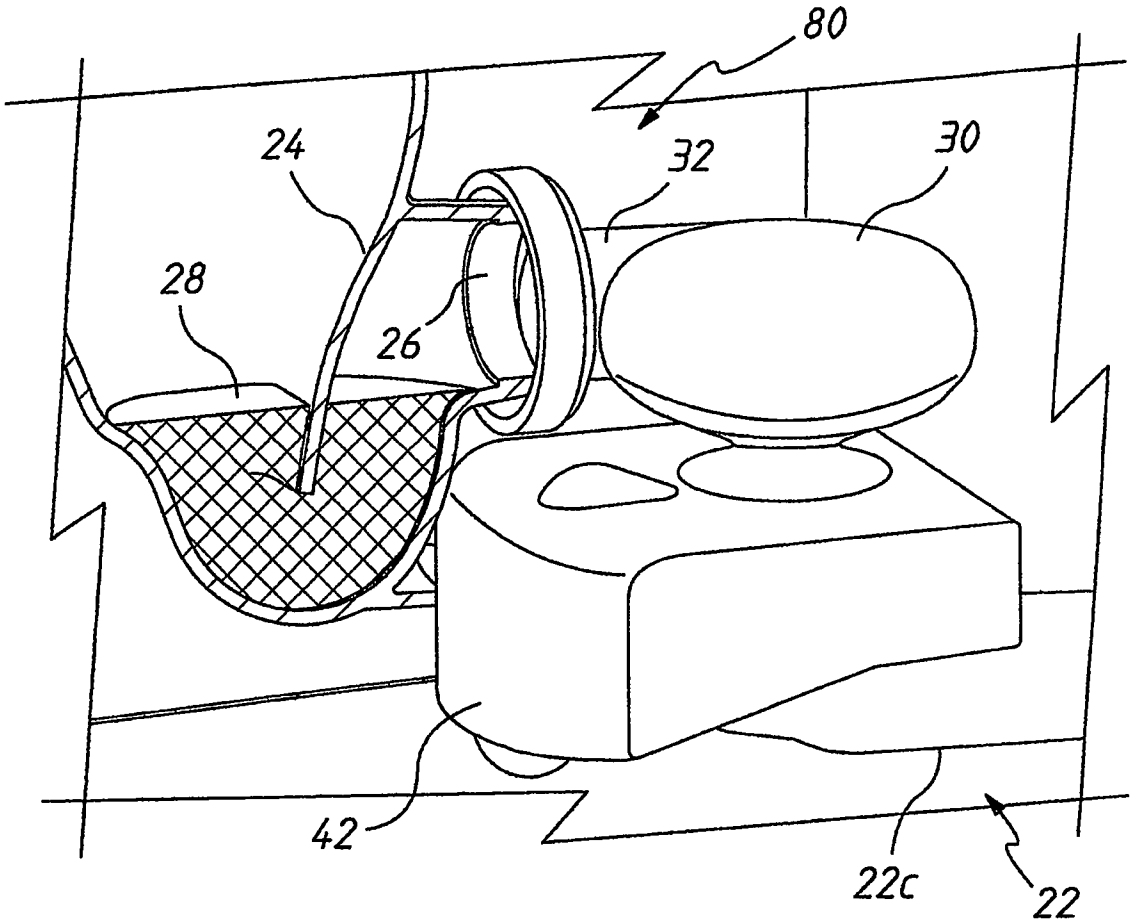
FIG. 10 is a cross sectional side view of a second embodiment of a device for improving drainline clearance, installed adjacent a cistern, prior to flushing of the toilet.
Figure 11:
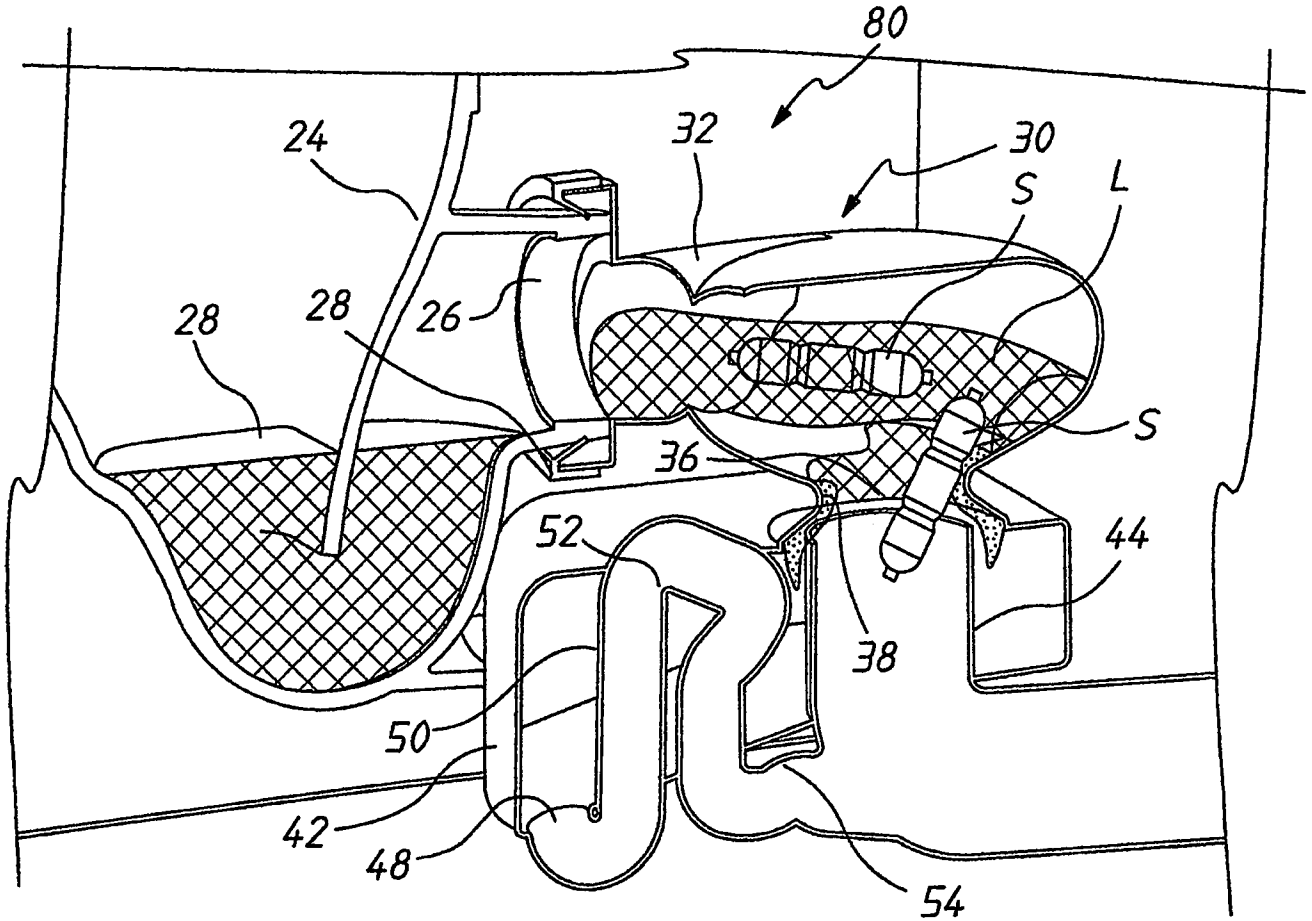
FIGS. 11 to 15 are cross sectional side views of the device and toilet shown in FIG. 10 showing sequential steps in the operation of the device and toilet.
Figure 12:
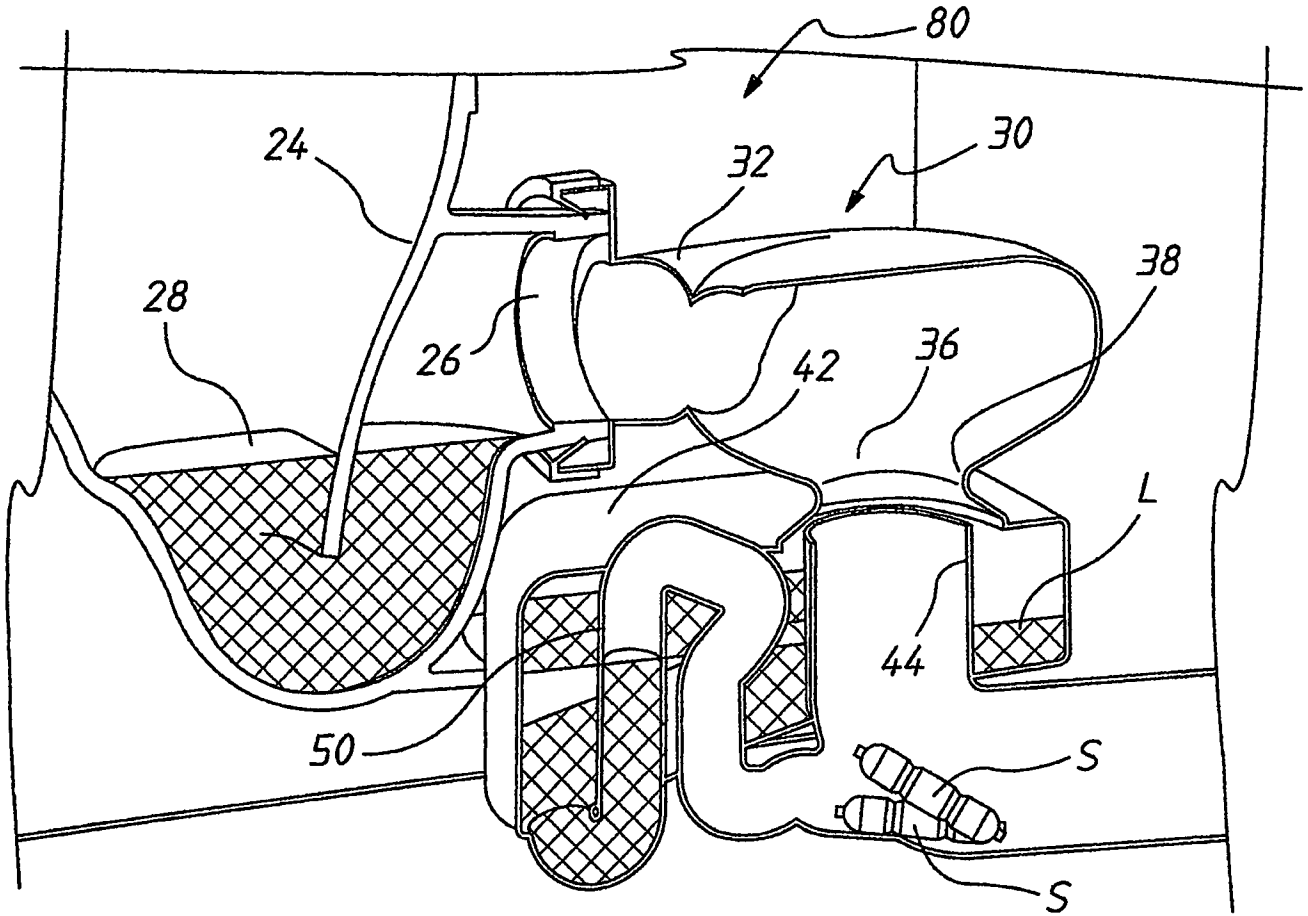
Figure 13:
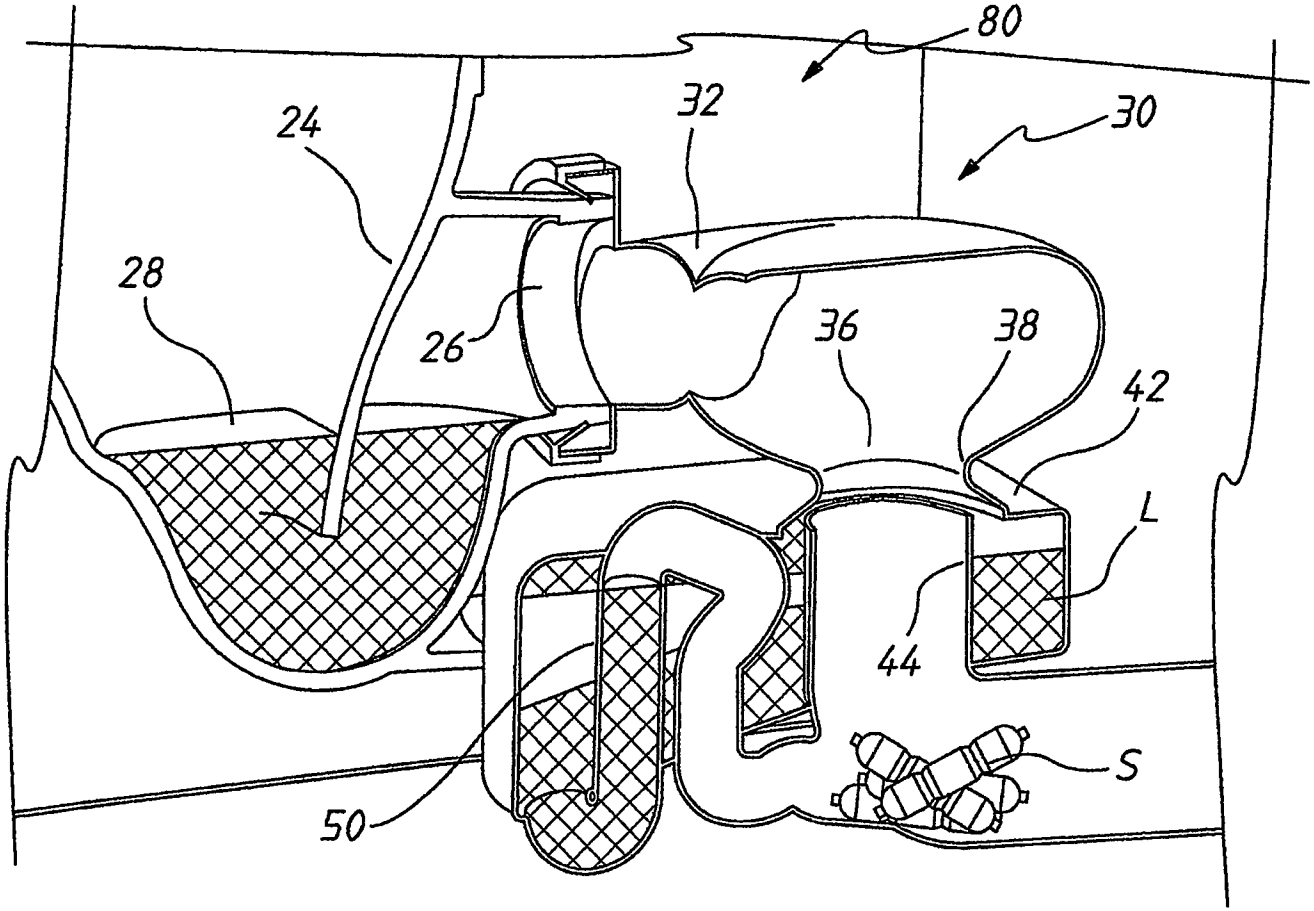
Figure 14:
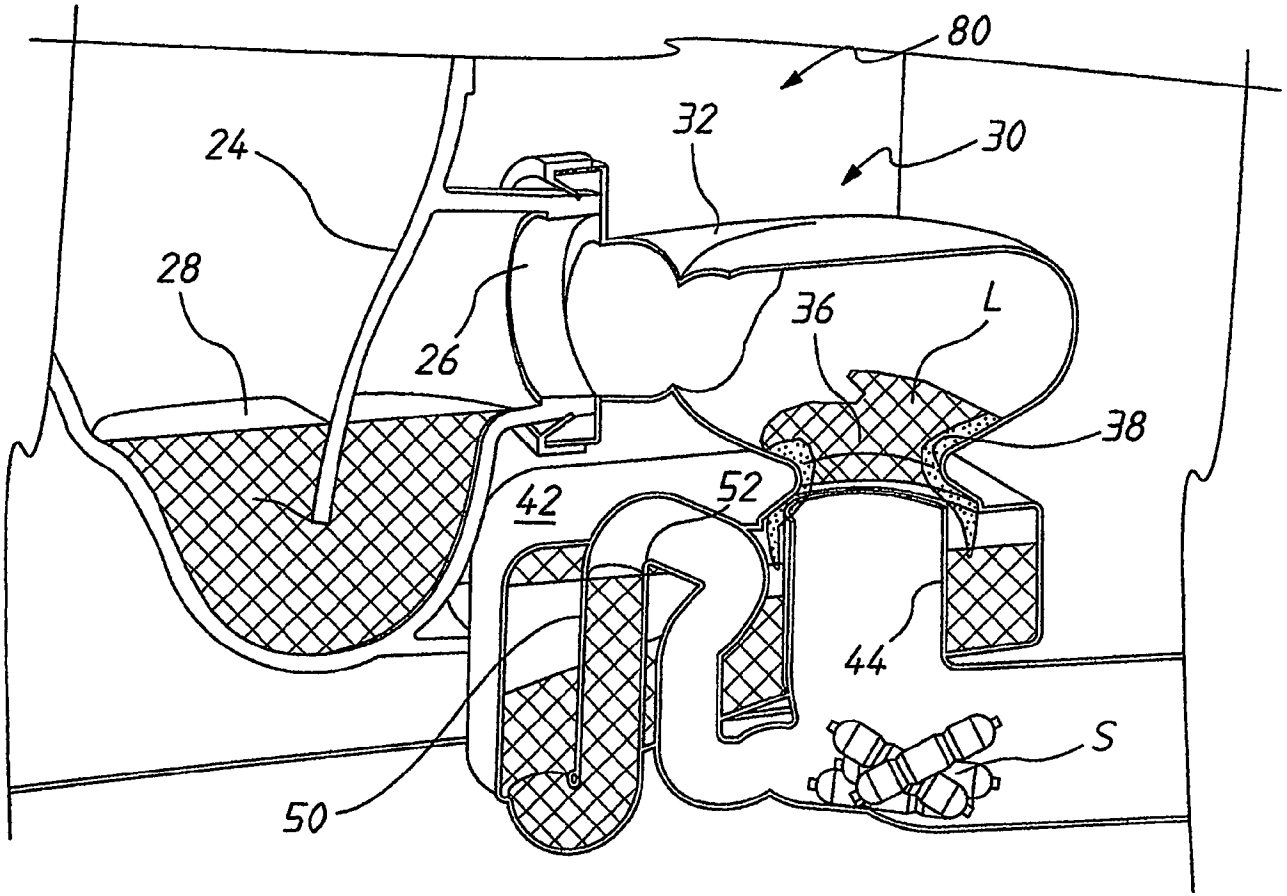
Figure 15:
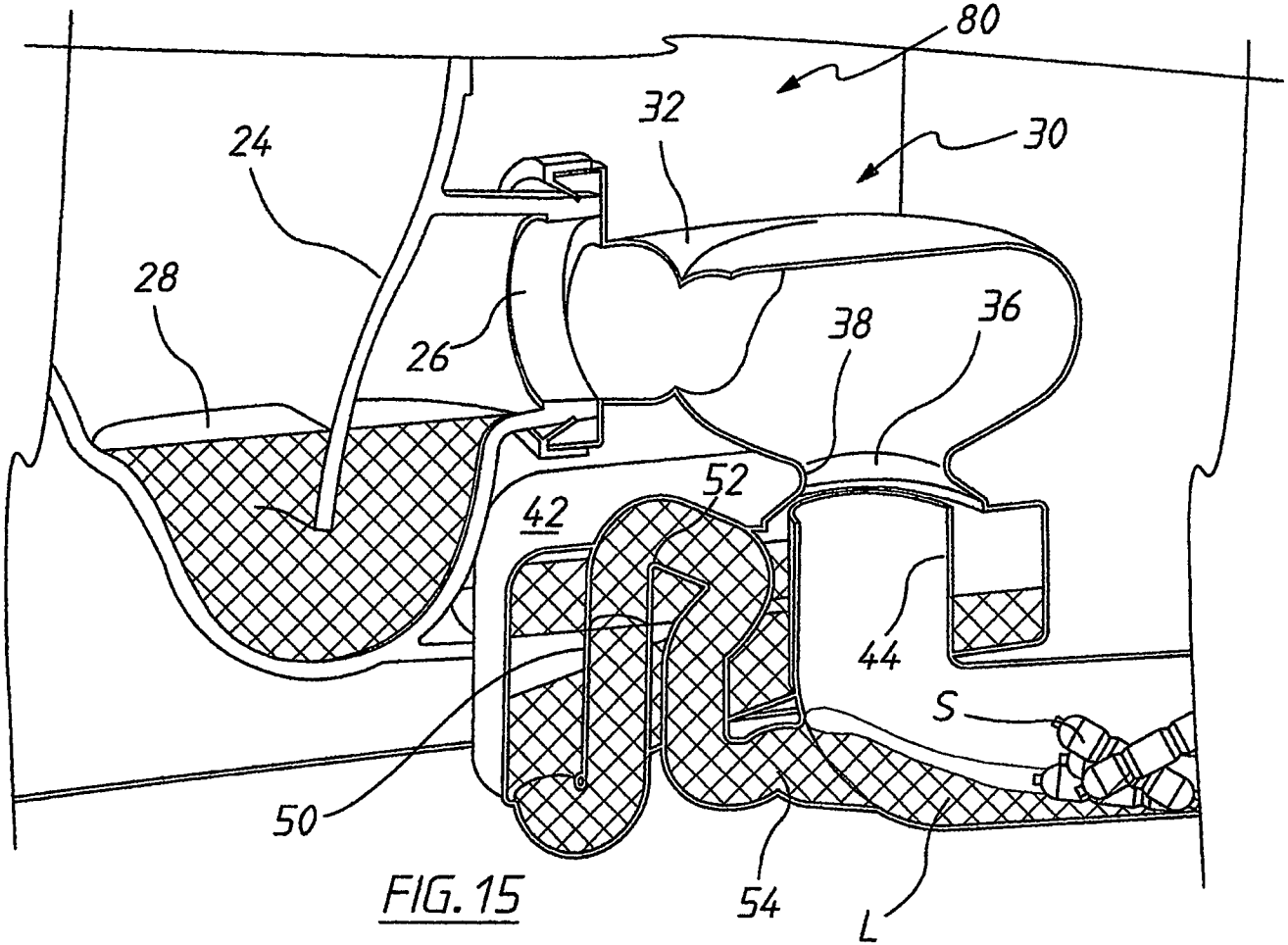

As shown in FIG. 9, the emptying of the contents of the reservoir through the syphon pipe 50 and the outlet pipe 54 provides a relatively large single volume of water, compared to that available with a single flush of the toilet, for improved transport and thus clearance of the solid waste S in the drainline 22. In the embodiment shown, the reservoir 42 provides an effective flush volume of about 7 liters, which is about triple the (approximately 2.5 liter) full flush volume of the toilet.

FIGS. 10 to 15 show a second embodiment of a device 80 for improving drainline clearance. Like features of the device 80 to those described with reference to the device 20 have been indicated with like reference numerals. The device 80 operates substantially in accordance with that previously described except it has been configured for "P trap" style installations for connection to a horizontally extending drainline 22*c*.

Although the invention has been described with reference to preferred embodiments, it would be appreciated by those skilled in the art that the invention may be embodied in many other forms.

The invention claimed is:

1. An ultra low flushing volume toilet comprising:

a toilet pan having a toilet pan outlet and a bottom, the bottom of the toilet pan configured to be placed on a floor; and a device substantially positioned between the toilet pan outlet and the bottom of the toilet pan, the device comprising:

a centrifuge separator arranged and configured to separate liquids and solids, the centrifuge separator comprising:

a substantially horizontal inlet connected to the toilet pan outlet;

a solids outlet primarily for solids and connected to a sewerage drainline; and a liquids outlet primarily for liquids;

a reservoir positioned beneath the centrifuge separator, the reservoir comprising:

an inlet in fluid communication with the liquids outlet of the centrifuge separator;

an upper narrowed portion arranged and configured to cause an acceleration in a height increase of the liquids up a syphon pipe; and a lower wider portion in communication with the upper narrowed portion at a boundary; and the syphon pipe connected to the inlet, the syphon pipe having a weir height positioned at substantially the same height as the boundary, the syphon pipe having a syphon pipe outlet positioned below the reservoir, the reservoir arranged and configured to syphonically empty substantially all of its contents into a sewerage drainline after at least 2 flushes of the toilet, wherein the centrifuge separator and the reservoir have a combined vertical dimension less than the maximum height of the toilet pan outlet such that the device is concealed when installed adjacent to the toilet.

2. The ultra low flushing volume toilet as claimed in claim 1, wherein the reservoir is adapted to syphonically empty substantially all of its contents into the sewerage drainline after between 2 to 4 flushes of the toilet.

3. The ultra low flushing volume toilet as claimed in claim 2, wherein the reservoir is adapted to syphonically empty substantially all of its contents into the sewerage drainline after 3 flushes of the toilet.

4. The ultra low flushing volume toilet as claimed in claim 1, wherein the liquids outlet also functions as the inlet of the reservoir.

5. The ultra low flushing volume toilet as claimed in claim 1, wherein the substantially horizontal inlet has a slight downward fall away from the toilet pan outlet.

6. The ultra low flushing volume toilet as claimed in claim 5, wherein the substantially horizontal inlet has about a 5 mm downward fall away from the toilet pan outlet over its length.

7. The ultra low flushing volume toilet as claimed in claim 1, wherein the centrifuge separator has a substantially central lower opening through which the solids are directed, with the liquids being directed along the inner surface of the opening to the reservoir.

8. The ultra low flushing volume toilet as claimed in claim 1, wherein the centrifuge separator has horizontal dimensions larger than its maximum vertical dimension.

9. The ultra low flushing volume toilet as claimed in claim 1, wherein the reservoir has horizontal dimensions larger than its maximum vertical dimension.

10. The ultra low flushing volume toilet as claimed in claim 1, wherein the liquids outlet includes a series of inwardly facing fins.

11. The ultra low flushing volume toilet as claimed in claim 10, wherein the inwardly facing fins are spiraled fins.

12. The ultra low flushing volume toilet as claimed in claim 1, wherein the device also includes a duct primarily for solids.

13. The ultra low flushing volume toilet as claimed in claim 12, wherein the duct has an inlet, beneath the solids outlet.

14. The ultra low flushing volume toilet as claimed in claim 13, wherein the duct inlet has an outwardly flared upper end.

15. The ultra low flushing volume toilet as claimed in claim 12, wherein the duct has a substantially vertical outlet connected to a floor mounted sewerage drainline connection.

16. The ultra low flushing volume toilet as claimed in claim 15, wherein the substantially vertical duct outlet, is a flanged outlet.

17. The ultra low flushing volume toilet as claimed in claim 12, wherein the duct has a substantially horizontal outlet connected to a wall mounted sewerage drainline connection.

18. The ultra low flushing volume toilet as claimed in claim 1, wherein the reservoir has an outlet connected to the inlet via the syphon pipe.

19. The ultra low flushing volume toilet as claimed in claim 12, wherein the syphon pipe outlet directs the contents of the reservoir into the sewerage drainline via the duct.

20. An ultra low flushing volume toilet comprising:

a toilet pan having a toilet pan outlet and a bottom, the bottom of the toilet pan configured to be placed on a floor; and a device substantially positioned between the toilet pan outlet and the bottom of the toilet pan, the device comprising:

a centrifuge separator arranged and configured to separate liquids and solids, the centrifuge separator comprising:

a substantially horizontal inlet connected to the toilet pan outlet;

a solids outlet primarily for solids and connected to a sewerage drainline; and a liquids outlet primarily for liquids;

a reservoir positioned beneath the centrifuge separator arranged and configured to store the liquids from the liquids outlet;

a syphon pipe connected to the reservoir, the syphon pipe having a syphon pipe outlet positioned below the reservoir, the reservoir adapted to syphonically empty substantially all of its contents into the sewerage drainline after at least two flushes of the toilet, wherein the centrifuge separator and the reservoir have a combined vertical dimension less than a maximum height of the toilet pan outlet.

* * * * *